US008290201B2

(12) United States Patent
Kamimura et al.

(10) Patent No.: US 8,290,201 B2
(45) Date of Patent: Oct. 16, 2012

(54) SPEAKER

(75) Inventors: Tomohiko Kamimura, Yao (JP); Hideo Yuasa, Yao (JP)

(73) Assignee: Hosiden Corporation, Yao-shi (JP)

( * ) Notice: Subject to any disclaimer, the term of this patent is extended or adjusted under 35 U.S.C. 154(b) by 252 days.

(21) Appl. No.: 12/813,893

(22) Filed: Jun. 11, 2010

(65) Prior Publication Data

US 2010/0316249 A1 Dec. 16, 2010

(30) Foreign Application Priority Data

Jun. 12, 2009 (JP) ..... 2009-140727

(51) Int. Cl.
*H04R 1/00* (2006.01)

(52) U.S. Cl. ..... 381/423; 381/396; 381/398; 381/424; 381/426; 381/432

(58) Field of Classification Search ..... 381/396, 381/398, 404, 423–424, 426–428, 432
See application file for complete search history.

(56) References Cited

U.S. PATENT DOCUMENTS

| | | | | |
|---|---|---|---|---|
| 4,118,605 | A * | 10/1978 | Kobayashi | 381/407 |
| 6,222,931 | B1 * | 4/2001 | Cesati | 381/427 |
| 6,236,733 | B1 * | 5/2001 | Kato et al. | 381/423 |
| 2003/0053651 | A1 * | 3/2003 | Koura et al. | 381/405 |
| 2005/0257999 | A1 * | 11/2005 | Tomiyama et al. | 181/168 |
| 2007/0223772 | A1 * | 9/2007 | Kaiwa | 381/398 |
| 2008/0080736 | A1 * | 4/2008 | Sumitani et al. | 381/407 |

FOREIGN PATENT DOCUMENTS

| | | |
|---|---|---|
| JP | 7-203585 | 8/1995 |
| JP | 2000-209693 | 7/2000 |
| JP | 2003339098 A * | 11/2003 |

* cited by examiner

*Primary Examiner* — Mohamad Musleh
*Assistant Examiner* — Tsz Chan
(74) *Attorney, Agent, or Firm* — Rankin, Hill & Clark LLP

(57) ABSTRACT

The invention provides a speaker in which a damper is effectively added without impairing the thinness of the speaker, and which, although the speaker is thin and small, exhibits high withstand input and high output power performances. A damper (14) is disposed between the lower end of a voice coil bobbin (12) and a magnet (3) of a magnetic circuit (5), and supports a vibration system (13) in a manner that the system is vibratable with respect to the magnet (3).

10 Claims, 7 Drawing Sheets

SPEAKER

TECHNICAL FIELD

The present invention relates to a thin and small speaker which can be used in a headphone, an earphone, a headset, a portable telephone, or the like.

BACKGROUND ART

Conventionally, a thin and small speaker is known in which a damper (see Patent Literature 1) having a structure that is usual in the field of a large speaker is employed (see Patent Literature 2). The damper cooperates with an edge portion in the periphery of a diaphragm to perform a function of holding a vibration system to a correct position to realize accurate vibration of the vibration system.

PRIOR ART LITERATURE

Patent Literature

[Patent Literature 1] Japanese Patent Application Laying-Open No. 7-203585

[Patent Literature 2] Japanese Patent Application Laying-Open No. 2000-209693

SUMMARY OF THE INVENTION

Problem to be Solved by the Invention

In the conventional thin and small speaker, the damper is added between the diaphragm and a lower frame to support an upper portion of a voice coil bobbin. When the damper is added, the thinness of the speaker is impaired. In a thin speaker, moreover, the distance with respect to the diaphragm cannot be prolonged. Even in the case where the damper is added, when a large power is input, therefore, the vibration system cannot accurately vibrate, thereby causing a problem in that rolling occurs.

It is an object of the invention to provide a speaker in which a damper is effectively added without impairing the thinness of the speaker, and which, although the speaker is thin and small, exhibits high withstand input and high output power performances.

Means for Solving the Problem

According to the invention, in a speaker comprising: a magnetic circuit having a yoke, a magnet, and a pole piece; a vibration system having a voice coil and diaphragm which are joined to each other through a voice coil bobbin; and a frame which holds the magnetic circuit and the vibration system, the voice coil being placed in a magnetic gap, a damper is disposed between the voice coil bobbin and the magnet, and the damper supports the vibration system in a manner that the vibration system is vibratable with respect to the magnet.

In the invention, preferably, the following configurations (A) to (E) are adequately added.

(A) The damper is annularly formed, and joins the whole periphery of the voice coil bobbin to the magnet.

(B) The damper joins an end portion of the voice coil bobbin which is opposite to the diaphragm, to the magnet.

(C) The diaphragm, the voice coil bobbin, and the damper are formed separately from one another, the damper is formed integrally with the voice coil bobbin, or the damper is formed separately from the voice coil bobbin which is formed integrally with a dome portion of the diaphragm.

(D) A damper fixing member which is formed into an annular shape that is fittable to the magnet, and to which an end portion of the damper on a side of the magnet is fixed is disposed.

(E) In (D) above, the damper fixing member is made of a metal that is a nonmagnetic material, or a resin.

Effects of the Invention

According to the invention, the damper which is disposed between the voice coil bobbin and the magnet supports the vibration system so as to be vibratable with respect to the magnet. By effectively using a space which is between the pole piece and the yoke, and which is not conventionally used, therefore, the damper can be added without ensuring a special space. Moreover, it is possible to obtain stable and accurate vibration of the vibration system in which the distance between an edge portion in the periphery of the diaphragm and the damper can be prolonged without changing the thickness of the speaker, and the upper end and lower portion of the vibration system are supported at two points of the edge portion in the periphery of the diaphragm and the damper, and which hardly causes rolling even when a large power is input. The withstand input performance can be improved. As a result, it is possible to provide a speaker which, although the speaker is thin and small, exhibits high withstand input and high output power performances. Furthermore, it is possible to cope with further thinness of the speaker.

According to the invention, it is possible to achieve the following effects.

In the case where the configuration of (A) is added, the damper is annularly formed, and joins the whole periphery of the voice coil bobbin to the magnet. As compared with a damper in which a voice coil bobbin is joined at a plurality of places to a magnet, therefore, a higher position holding function is obtained, and vibration of the vibration system which is more stable and accurate is obtained.

In the case where the configuration of (B) is added, the damper joins the end portion of the voice coil bobbin which is opposite to the diaphragm, to the magnet. Therefore, it is possible to obtain vibration of the vibration system in which the distance between the edge portion in the periphery of the diaphragm and the damper can be maximally prolonged without changing the thickness of the speaker, the upper and lower ends of the vibration system are supported at two point of the edge portion in the periphery of the diaphragm and the damper, and, as compared with a damper in which a voice coil bobbin is joined to a magnet in a place other than the end portion of the voice coil bobbin which is opposite to the diaphragm, a higher position holding function is obtained, and more stable and accurate vibration is obtained.

In the case where, in the configuration of (C), the configuration where the diaphragm, the voice coil bobbin, and the damper are formed separately from each other is added, each of the diaphragm, the voice coil bobbin, and the damper can be used while selecting an optimum material. In the case where the damper is formed integrally with the voice coil bobbin, or that where the damper is formed separately from the voice coil bobbin which is formed integrally with the dome portion of the diaphragm is added, the number of parts in the vibration system, and that of assembling steps can be reduced, and the productivity can be improved.

In the case where the configuration of (D) is added, the damper fixing member which is formed into an annular shape that is fittable to the magnet, and to which the end portion of the damper on the side of the magnet is fixed is disposed. Therefore, the work of fixing the magnet to the end portion of the damper on the side of the magnet can be performed easily and accurately, and the productivity can be improved. While selectively using the surface which is parallel to the vibration direction of the vibration system, and the surfaces which are perpendicular to the vibration direction of the vibration system depending on, for example, the shape or size of the magnet, furthermore, the end portion of the damper on the side of the magnet can be fixed easily and accurately.

In the case where the configuration of (E) is added, the damper fixing member is made of a metal that is a nonmagnetic material, or a resin, and hence the damper fixing member does not affect the magnetic circuit.

MODE FOR CARRYING OUT THE INVENTION

Hereinafter, Examples 1 to 5 in an embodiment of the invention will be described in detail with reference to the drawings.

Example 1

Figure 1:
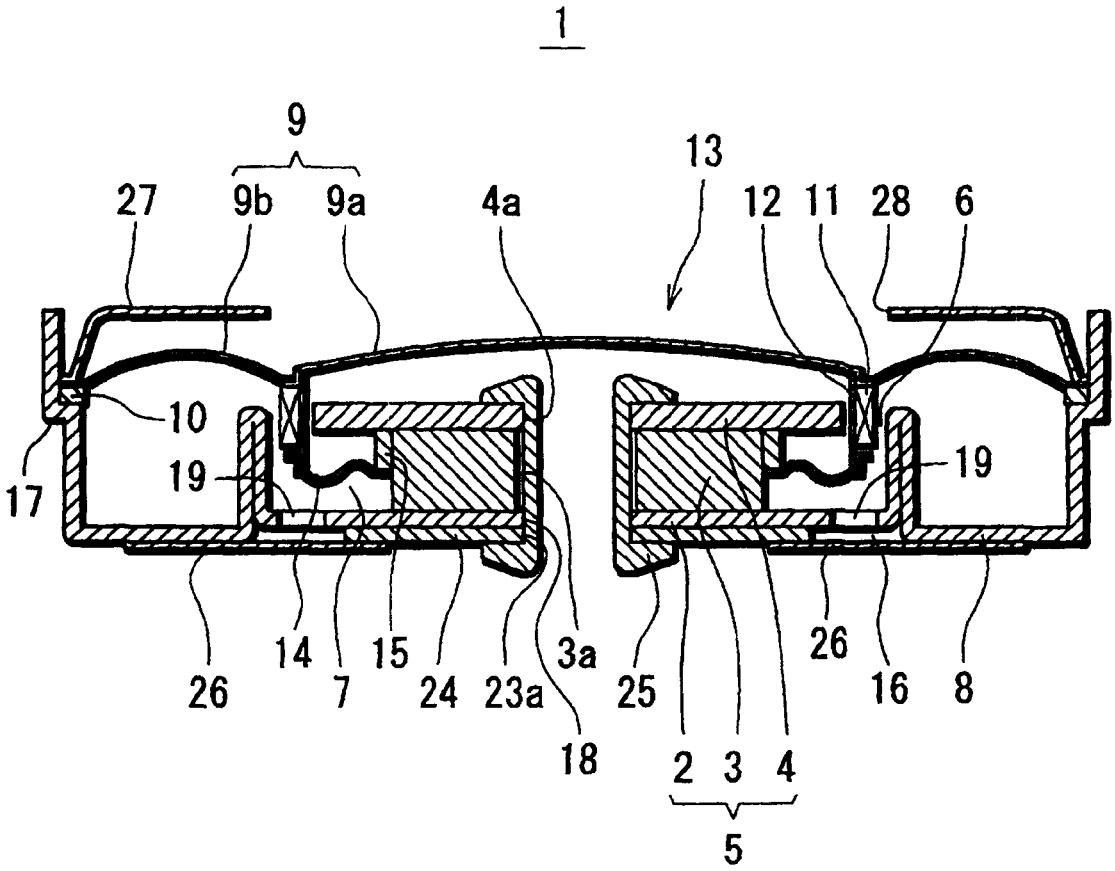
FIG. 1 is a sectional view showing a speaker of an embodiment of the invention (Example 1).

FIG. 1 is a sectional view of a speaker of Example 1 of the invention. In the speaker 1, a circular magnetic circuit 5 of the internal magnet type is configured by: a yoke 2 which is made of a magnetic material, and which has a bottomed tubular shape; a columnar magnet 3 which is placed and fixed into the yoke 2, and which is formed by a permanent magnet; and a disk-like pole piece 4 which is placed and fixed onto the upper face of the magnet 3, which cooperates with a bottom plate portion of the yoke 2 to sandwich the magnet 3, and which is made of a magnetic material. The diameter of the pole piece 4 is smaller than the inner diameter of the yoke 2, and a gap between the outer peripheral face of the pole piece 4 and inner peripheral face of the peripheral sidewall of the yoke 2 which are opposed to each other in a radial direction of the magnetic circuit 5 is formed as a magnetic gap 6 of the magnetic circuit 5. The diameter of the magnet 3 is smaller than the pole piece 4, and a space 7 is formed between an outer peripheral edge portion of the pole piece 4 which extends outward in a radial direction from the magnet 3, and the bottom plate of the yoke 2 which is below the portion.

An outer peripheral edge portion of a circular diaphragm 9 is bonded and fixed to that of a frame 8, and the diaphragm 9 is placed in an upper portion of the speaker 1.

The diaphragm 9 has a dome-shaped dome portion 9*a* in which the upper face is convex and the lower face is concave (or an inverted dome portion in which the upper face is concave and the lower face is convex may be possible), in a middle portion, and a circular annular edge portion 9*b* which surrounds the whole periphery of the dome portion 9*a*, in the periphery. The diaphragm 9 is configured by independently forming the dome portion 9*a* and the edge portion 9*b*, and thereafter bonding and fixing together an outer peripheral edge portion of the dome portion 9*a* and an inner peripheral edge portion of the edge portion 9*b*. A circular diaphragm ring 10 is bonded and fixed to the lower face of an outer peripheral edge portion of the edge portion 9*b* (an outer peripheral edge portion of the diaphragm 9), and the outer peripheral edge portion of the diaphragm 9 is bonded and fixed to an outer peripheral edge portion of the frame 8 through the diaphragm ring 10. The diaphragm 9 is supported in the periphery or the edge portion 9*b* so that it can vertically vibrate with respect to the frame 8.

A tubular voice coil 11 is coupled with the lower face of the circular boundary between the dome portion 9*a* of the diaphragm 9 and the edge portion 9*b*. The voice coil 11 is inserted in the magnetic gap 6 of the magnetic circuit 5 so that the coil can vertically reciprocate (vibrate). The voice coil 11 is configured by winding a highly conductive wire material around the outer peripheral surface of a tubular voice coil bobbin 12, an upper end portion of the voice coil bobbin 12 is bonded and fixed to the lower face of the circular boundary between the dome portion 9*a* of the diaphragm 9 and the edge portion 9*b*, and the voice coil 11 is inserted in the magnetic gap 6 of the magnetic circuit 5 so that the coil can vertically reciprocate (vibrate).

A vibration system 13 is configured by the voice coil 11 and diaphragm 9 which are joined to each other by the voice coil bobbin 12, and supported in the edge portion 9*b* in the periphery of the diaphragm 9 so that it can vertically reciprocate (vibrate) with respect to the frame 8.

As described above, the speaker 1 comprises: the magnetic circuit 5 having the yoke 2, the magnet 3, and the pole piece 4; the vibration system 13 having the voice coil 11 and diaphragm 9 which are joined to each other through the voice coil bobbin 12; and the frame 8 which holds the magnetic circuit 5 and the vibration system 13. The voice coil 11 is placed in the magnetic gap 6. In the speaker, when a current is supplied from an external circuit to the voice coil 11 through a pair of external connection terminals (not shown), the interaction between magnetic fluxes which are directed in a substantially horizontal direction in the magnetic gap 6, and the current flown through the voice coil 11 causes the voice coil 11 to vertically reciprocate, and the motion is transmitted to the diaphragm 9 by the voice coil bobbin 12, so that the diaphragm 9 vertically vibrates while setting the peripheral edge portion 9*b* as a fulcrum to generate a sound. Namely, the speaker converts an electric signal to a sound.

Figure 2:
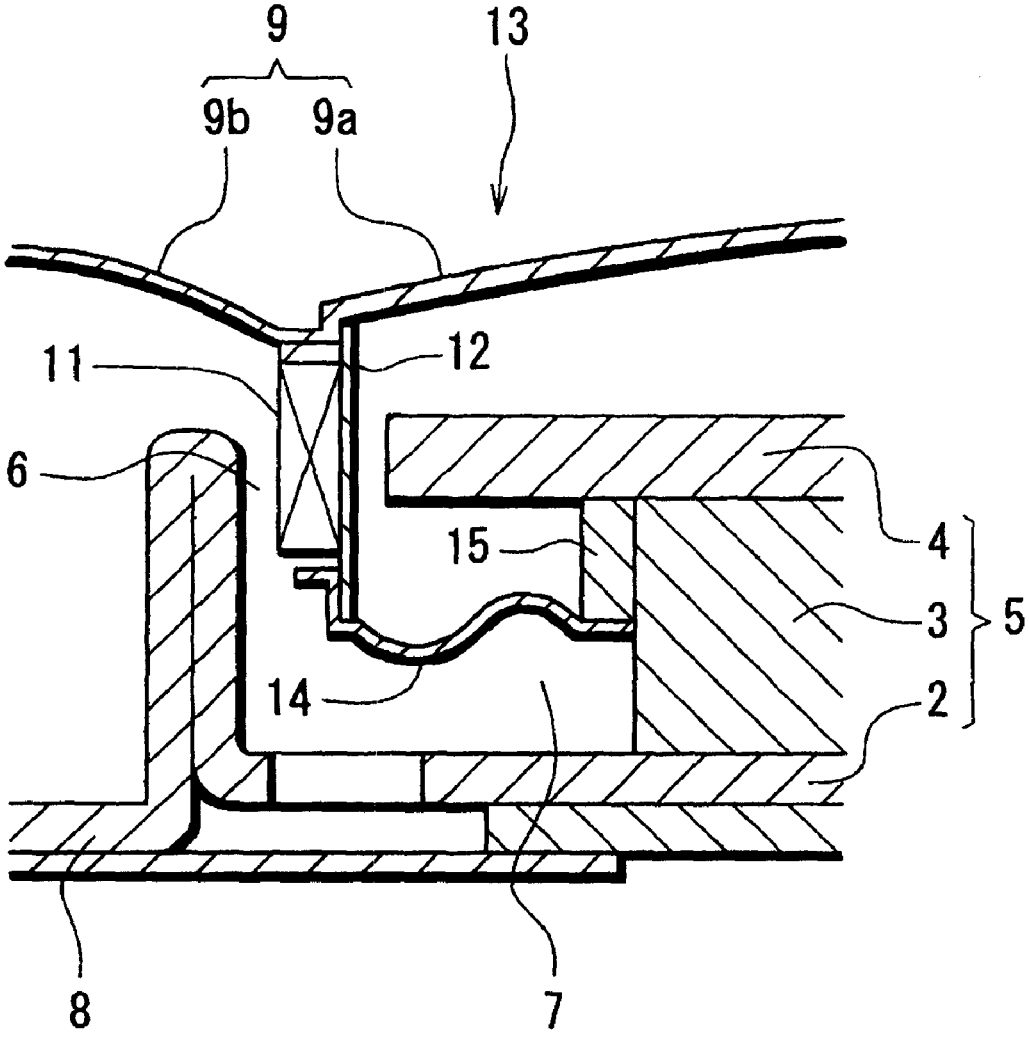
FIG. 2 is an enlarged sectional view of main portions of the speaker of the embodiment of the invention (Example 1).

In the thus configured speaker 1, as shown in FIG. 2, a damper 14 is disposed between the voice coil bobbin 12 and the magnet 3, and the damper supports the vibration system 13 so as to be vibratable with respect to the magnet 3. The damper 14 is configured by a resin film, and disposed between the magnet 3 and voice coil bobbin 12 which are opposed to each other in a radial direction of the magnetic circuit 5, and below the magnetic gap 6 of the magnetic circuit 5. In the magnetic circuit 5 of the internal magnet type, an inner end portion (an end portion on the side of the magnet 3) of the damper is coupled to the magnet 3, and an outer end portion (an end portion on the side of the voice coil 11) is coupled to the voice coil bobbin 12, so that a lower portion (a portion which is below the magnetic gap 6) of the vibration system 13 is supported so as to be vibratable with respect to the magnet 3. The damper cooperates with the edge portion 9*b* in the periphery of the diaphragm 9 to perform a function of holding the vibration system 13 to a correct position to realize accurate vibration of the vibration system 13.

As described above, in the speaker 1, the damper 14 is disposed between the voice coil bobbin 12 and the magnet 3, and the damper supports the vibration system 13 so as to be vibratable with respect to the magnet 3. By effectively using the space 7 which is between the pole piece 4 and the yoke 2, and which is not conventionally used, therefore, the damper 14 can be added without ensuring a special space. Moreover, it is possible to obtain stable and accurate vibration of the vibration system 13 in which the distance between the edge portion 9*b* in the periphery of the diaphragm 9 and the damper 14 can be prolonged without changing the thickness of the speaker 1, and the upper end and lower portion of the vibration system 13 are supported at two points of the edge portion 9*b* in the periphery of the diaphragm 9 and the damper 14, and which hardly causes rolling (lateral swing) even when a large power is input. The withstand input performance can be improved. As a result, it is possible to provide a speaker which, although the speaker is thin and small, exhibits high withstand input and high output power performances. Furthermore, it is possible to cope with further thinness of the speaker.

The damper 14 may be a flat planar damper which is placed in a plane perpendicular to the axial line (the center line) of the magnetic circuit 5. In the damper 14, however, a concentric waveform is formed in order to obtain a larger amplitude of the vibration system 13.

The damper 14 may be a damper in which a plurality of places that are equally spaced from one another in the circumferential direction of the voice coil bobbin 12 are joined to the magnet 3. In order to, as compared with the damper, obtain a higher position holding function, and vibration of the vibration system 13 which is more stable and accurate, the damper 14 is annularly formed, and joins the whole periphery of the voice coil bobbin 12 to the magnet 3. In the case of the annular damper 14, holes for ensuring necessary air permeability are opened, so that both a damper function and air permeability which are requested in the damper 14 are attained.

The damper 14 may be a damper which joins a portion (a portion which is below the magnetic gap 6) other than the lower end (an end portion which is opposite to the side of the vibration system 13) of the voice coil bobbin 12, to the magnet 3. In order to, as compared with the damper, obtain a higher position holding function, and vibration of the vibration system 13 which is more stable and accurate, the damper 14 is configured so that the lower end of the voice coil bobbin 12 is joined to the magnet 3, the distance between the edge portion 9*b* in the periphery of the diaphragm 9 and the damper 14 can be maximally prolonged without changing the thickness of the speaker 1, and the upper and lower ends of the vibration system 13 are supported at two points of the edge portion 9*b* in the periphery of the diaphragm 9 and the damper 14.

The diaphragm 9, the voice coil bobbin 12, and the damper 14 are formed separately from one another, and each of the diaphragm 9, the voice coil bobbin 12, and the damper 14 can be used while selecting an optimum material. Also in the diaphragm 9, since the dome portion 9*a* and the edge portion 9*b* are separately formed, each of the dome portion 9*a* and the edge portion 9*b* can be used while selecting an optimum material.

A circular damper ring 15 which is fittable onto the magnet 3, and which is made of a metal that is a nonmagnetic material, or a resin is bonded and fixed to an end portion of the damper 14 on the side of the magnet 3. The end portion of the damper 14 on the side of the magnet 3 is bonded and fixed to the outer peripheral face of the magnet 3 through the damper ring 15. In this way, the damper ring 15 which is formed into an annular shape that is fittable to the magnet 3, and to which the end portion of the damper 14 on the side of the magnet 3 is fixed is disposed, whereby the work of fixing the magnet 3 to the end portion of the damper 14 on the side of the magnet 3 can be performed easily and accurately, and the productivity can be improved. While selectively using the surface (the vertical surface: the outer peripheral surface of the damper ring 15) which is parallel to the vibration direction of the vibration system 13, and the surfaces (horizontal surfaces: the upper and lower end faces of the damper ring 15) which are perpendicular to the vibration direction of the vibration system 13 depending on, for example, the shape or size of the magnet 3, furthermore, the end portion of the damper 14 on the side of the magnet 3 can be fixed easily and accurately. Moreover, the damper ring 15 is made of a metal that is a nonmagnetic material, or a resin, and hence the damper ring does not affect the magnetic circuit 5.

Figure 3:
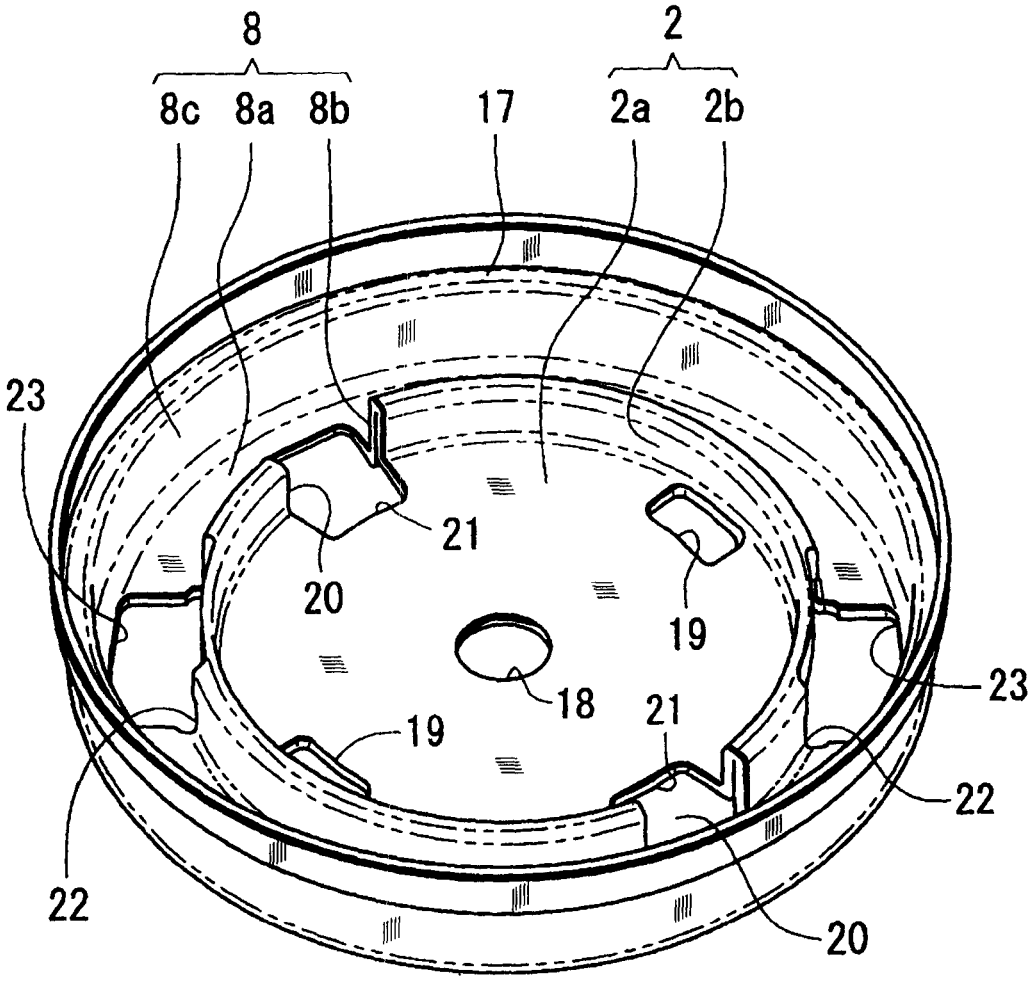
FIG. 3 is a perspective view of a frame of the speaker of the embodiment of the invention (Example 1).

As shown in FIG. 3, the yoke 2 and the frame 8 are integrally formed by applying a pressing process on one sheet-like metal material.

Namely, middle and peripheral portions of one sheet-like metal material (magnetic material) are drawing-processed to raise a circular tubular outside wall from the outer peripheral edge of a circular plate-like bottom plate, and a circular tubular double wall which is an inside wall that is smaller in diameter than the outside wall, and which has a folded portion in an upper portion is raised from the disk-like bottom plate toward the inner side of the outside wall with forming a predetermined gap therefrom. The bottomed cylindrical yoke 2 is formed in a middle portion by: a circular bottom plate 2*a* formed by a bottom plate middle portion in the inner wall of the double wall which is raised from the outer peripheral edge; and a tubular peripheral side wall 2*b* formed by the inner wall of the double wall. The circular annular frame 8 having a U-like sectional shape which is upward opened is formed in the periphery of the yoke 2 by: a circular annular bottom plate 8*a* formed by a bottom-plate peripheral edge portion in which the outer wall of the double wall is raised from the inner peripheral edge, and the outside wall is raised from the outer peripheral edge; a tubular inner peripheral side wall 8*b* formed by the outer wall of the double wall; and an outer peripheral side wall 8*c* formed by the outside wall.

In the yoke 2, the bottom plate 2*a* is formed by lowering the bottom plate 8*a* of the frame 8 by one step. A shallow circular recess 16 (see FIG. 1) is disposed on the back face side of the yoke 2, and the outer peripheral side wall 8*c* of the frame 8 is formed taller than the peripheral side wall 2*b* of the yoke 2 and the inner peripheral side wall 8*b* (the double wall) of the frame 8. A horizontal step portion 17 is disposed at a level which is higher than the peripheral side wall 2*b* of the yoke 2 of the outer peripheral side wall 8*c* of the frame 8 and the inner peripheral side wall 8*b* of the frame 8 (the double wall). The outer peripheral side wall 8*c* of the frame 8 which is higher than the step portion 17 is formed to be larger in diameter than the outer peripheral side wall 8*c* of the frame 8 which is lower than the step portion 17. An outer peripheral edge portion of the edge portion 9*b* in the periphery of the diaphragm 9 is bonded and fixed to the step portion 17 through the diaphragm ring 10.

The pressing steps include a boring process, and at least two or more openings are disposed in the circular bottom plate in the integral structure of the yoke 2 and the frame 8. The followings are disposed: a circular first opening 18 which is formed in one place of a center portion of the bottom plate 2*a* of the yoke 2; a pair of second openings 19 which are formed in two point-symmetric places separated by 180° in an outer peripheral edge portion of the bottom plate 2*a* of the yoke 2; a pair of third openings 21 which are in two point-symmetric places separated by 180° in an outer peripheral edge portion of the bottom plate 2*a* of the yoke 2, which are extended radially outward from two point-symmetric places separated by 180° and positionally shifted by 90° in one direction from the pair of second openings 19, which are continuously formed to two point-symmetric places separated by 180° in an inner peripheral edge portion of the bottom plate 8*a* of the frame 8, and in which cutouts 20 are formed in two point-symmetric places separated by 180° in the peripheral side wall 2*b* of the yoke 2 and the inner peripheral side wall 8*b* of the frame 8 (the double wall); and a pair of fourth openings 23 which are in two point-symmetric places separated by 180° in the the bottom plate 8*a* of the frame 8, which are extended radially inward from two point-symmetric places separated by 180° and positionally shifted by about 45° in one direction (the direction in which the pair of third openings 21 are shifted with respect to the pair of second openings 19) from the pair of third openings 21, which are formed to the upper end (the folded portion of the double wall) of the inner peripheral side wall 8*b* of the frame 8, and in which cutouts 22 are formed in two point-symmetric places separated by 180° in the outer peripheral wall (a lower portion of the inner peripheral side wall 8*b* of the frame 8 which is below the bottom plate 2*a* of the yoke 2) of the recess 16.

In the integral structure of the yoke 2 and the frame 8, the yoke 2 and the frame 8 can be integrally formed by a simple pressing process, the number of parts in the speaker 1, and that of assembling steps can be reduced, and the productivity can be improved. While suppressing the thickness of the speaker 1, necessary strength can be easily ensured, and hence the speaker 1 can be further miniaturized and thinned.

As shown in FIG. 1, a substantially rectangular plate-like printed circuit board 24 having a thickness which is equivalent to the depth of the recess 16 is attached to the back face side of the yoke 2. Both end portions of the printed circuit board 24 are fitted into the fourth openings 23 through the cutouts 22, thereby positioning the printed circuit board 24. A pair of planar external connection terminals (not shown) for surface mounting, a pair of external connection terminals each of which is configured by an elastic member such as a plate spring or a coil spring, and the like are disposed on the lower face of the printed circuit board 24. A pair of planar internal connection terminals which are conductive with the pair of external connection terminals are disposed on the upper faces of both end portions of the printed circuit board 24. Two lead wires (not shown) of the voice coil 11 are drawn out from the magnetic circuit 5 toward the frame 8 through the cutouts 20, led to the fourth openings 23 in the frame 8, and connected by spot-welding or soldering to the internal connection terminals which are exposed in the fourth openings 23 to the interior of the frame 8, so that an electric signal is supplied from an external circuit to the voice coil 11 through the external connection terminals, the internal connection terminals, and the lead wires.

The integration (the assembling of the magnetic circuit 5) of the yoke 2, the magnet 3, and the pole piece 4, and the fixation of the yoke 2 to the printed circuit board are collectively performed in the following manner. Center holes 23*a*, 3*a*, 4*a* which are substantially equal in diameter to the first opening 18 (the center hole of the yoke 2) are disposed in the printed circuit board 24, the magnet 3, and the pole piece 4, respectively, a rivet 25 is passed through center portions of the printed circuit board 24, the yoke 2, the magnet 3, and the pole piece 4 through the first opening 18 and the center holes 23*a*, 3*a*, 4*a*, and the upper or lower end of the rivet 25 is crushed to conduct caulking fixation.

The third openings 21 are used as holes into which, during a process of assembling the speaker 1, an assembling jig or the like is to be inserted from the outside of the speaker 1 into the interior, or rear sound holes. The second openings 19 are used as rear sound holes for the speaker 1. The faces of the second openings 19 on the side of the back face of the speaker 1 are covered by damping cloth 26 having air permeability.

As described above, in the integral structure of the yoke 2 and the frame 8, the various functions can be added by the openings which can be formed by a simple pressing process.

Alternatively, the yoke and the frame may be integrally formed by applying a drawing process on one sheet-like metal material (magnetic material) to form a bottomed tubular frame, and then a simple pressing process in which at least two places of the bottom plate of the frame are cut and raised to form a yoke having a bottom plate and a plurality of peripheral walls that are formed by raising the peripheral edge portion of the bottom plate.

A sheet metal-made baffle 27 which covers and protects the diaphragm 9 is fitted and fixed to an upper portion of the frame 8. A front sound hole 28 of the speaker 1 is disposed in the baffle 27. The face of the front sound hole 28 on the front side of the speaker 1 is covered by damping cloth (not shown) having air permeability.

Example 2

Figure 4:
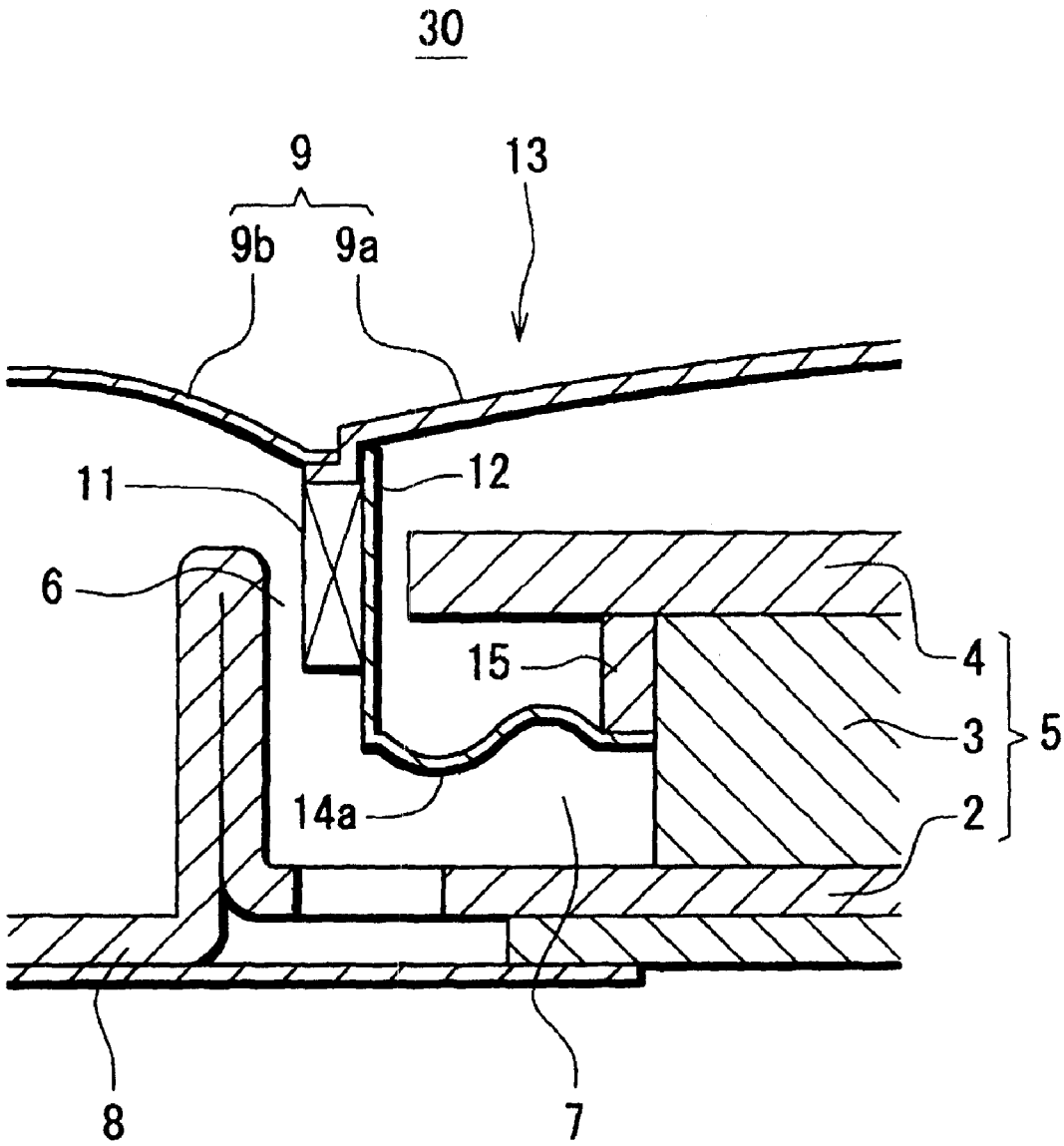
FIG. 4 is an enlarged sectional view of main portions of another speaker of the embodiment of the invention (Example 2).

FIG. 4 is an enlarged sectional view of main portions of a speaker of Example 2 of the invention. The speaker 30 is different from the speaker 1 of Example 1, only in a configuration where, in place of the damper 14 of the speaker 1 of Example 1, a damper 14*a* which is formed integrally with the voice coil bobbin 12 is disposed, and identical with the speaker 1 of Example 1 in the configuration other than the above. Therefore, the identical components are denoted by the same reference numerals, and their detailed description is omitted. As in the speaker 30 of the example, the damper 14*a* is formed integrally with the voice coil bobbin 12, whereby the number of parts in the vibration system 13, and that of assembling steps can be reduced, and the productivity can be improved.

Example 3

Figure 5:
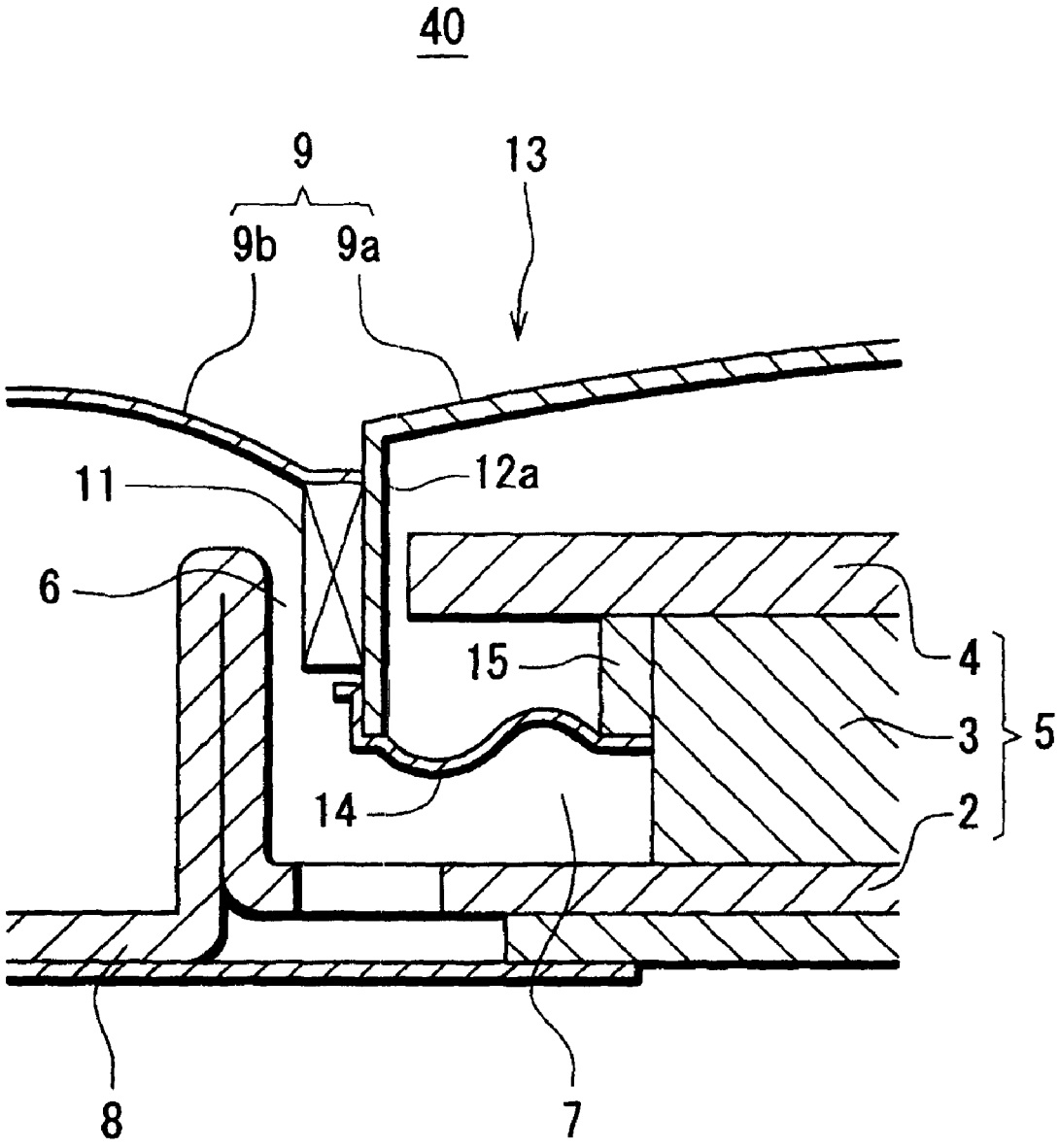
FIG. 5 is an enlarged sectional view of main portions of a further speaker of the embodiment of the invention (Example 3).

FIG. 5 is an enlarged sectional view of main portions of a speaker of Example 3 of the invention. The speaker 40 is different from the speaker 1 of Example 1, only in a configuration where, in place of the voice coil bobbin 12 of the speaker 1 of Example 1, a voice coil bobbin 12*a* which is formed integrally with the dome portion 9*a* of the diaphragm 9 is disposed, and the damper 14 is formed separately from the voice coil bobbin 12*a* that is formed integrally with the dome portion 9*a* of the diaphragm 9, and identical with the speaker 1 of Example 1 in the configuration other than the above. Therefore, the identical components are denoted by the same reference numerals, and their detailed description is omitted. As in the speaker 40 of the example, the damper 14 is formed separately from the voice coil bobbin 12*a* that is formed integrally with the dome portion 9*a* of the diaphragm 9, whereby the number of parts in the vibration system 13, and that of assembling steps can be reduced, and the productivity can be improved.

Example 4

Figure 6:
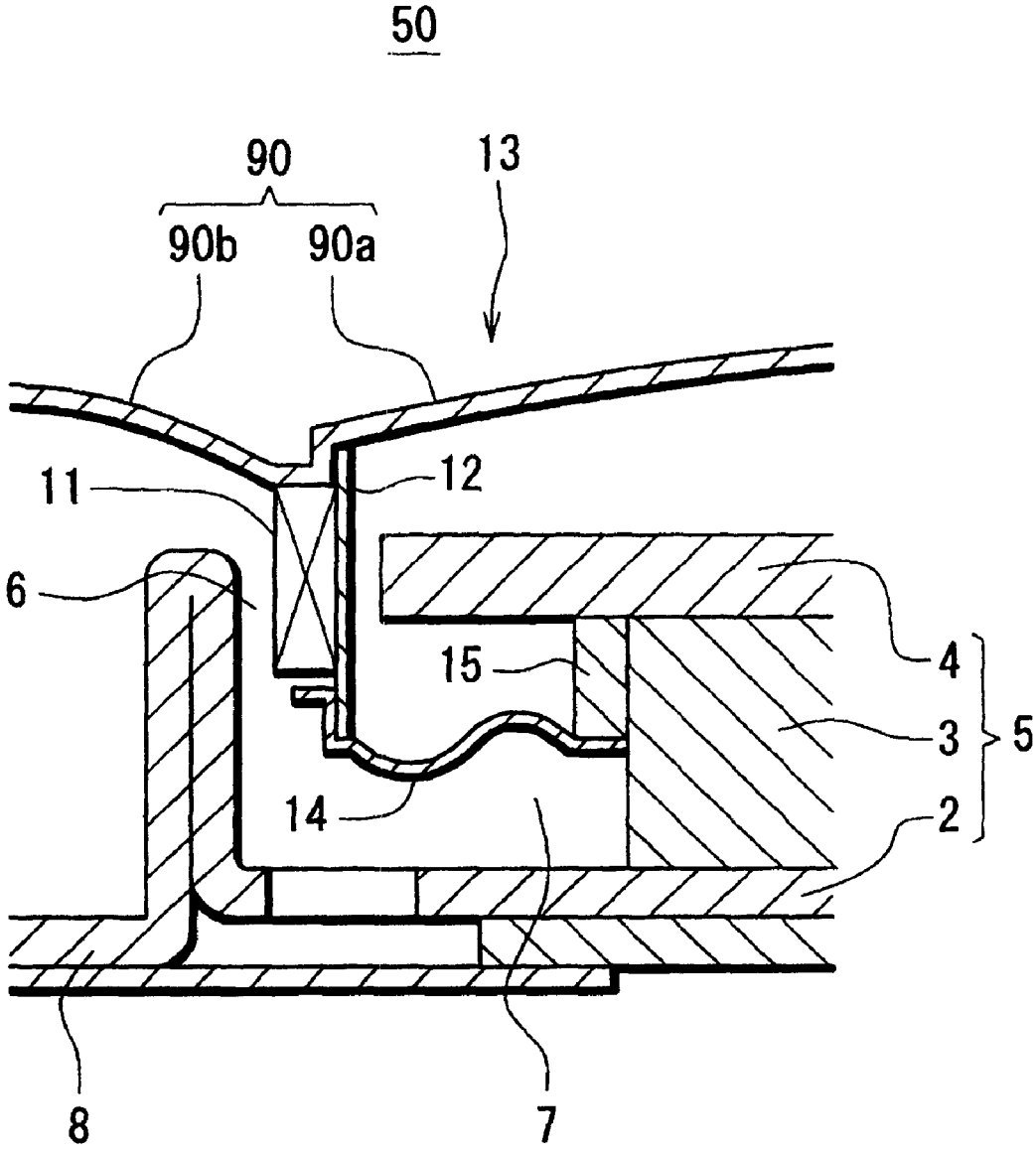
FIG. 6 is an enlarged sectional view of main portions of a still further speaker of the embodiment of the invention (Example 4).

FIG. 6 is an enlarged sectional view of main portions of a speaker of Example 4 of the invention. The speaker 50 is different from the speaker 1 of Example 1, only in a configuration where, in place of the diaphragm 9 of the speaker 1 of Example 1, a diaphragm 90 in which a dome portion 90*a* and an edge portion 90*b* are integrally formed is disposed, and identical with the speaker 1 of Example 1 in the configuration other than the above. Therefore, the identical components are denoted by the same reference numerals, and their detailed description is omitted. As in the speaker 50 of the example, the dome portion 90*a* and the edge portion 90*b* are integrally formed in the diaphragm 90, whereby the number of parts in the vibration system 13, and that of assembling steps can be reduced, and the productivity can be improved. In the speaker 50 of the example, the voice coil bobbin 12 and the damper 14 are formed separately from the diaphragm 90 in which the dome portion 90*a* and the edge portion 90*b* are integrally formed. As in the speaker 30 of Example 2, alternatively, the voice coil bobbin 12 and the damper 14 may be integrally formed.

Example 5

Figure 7:
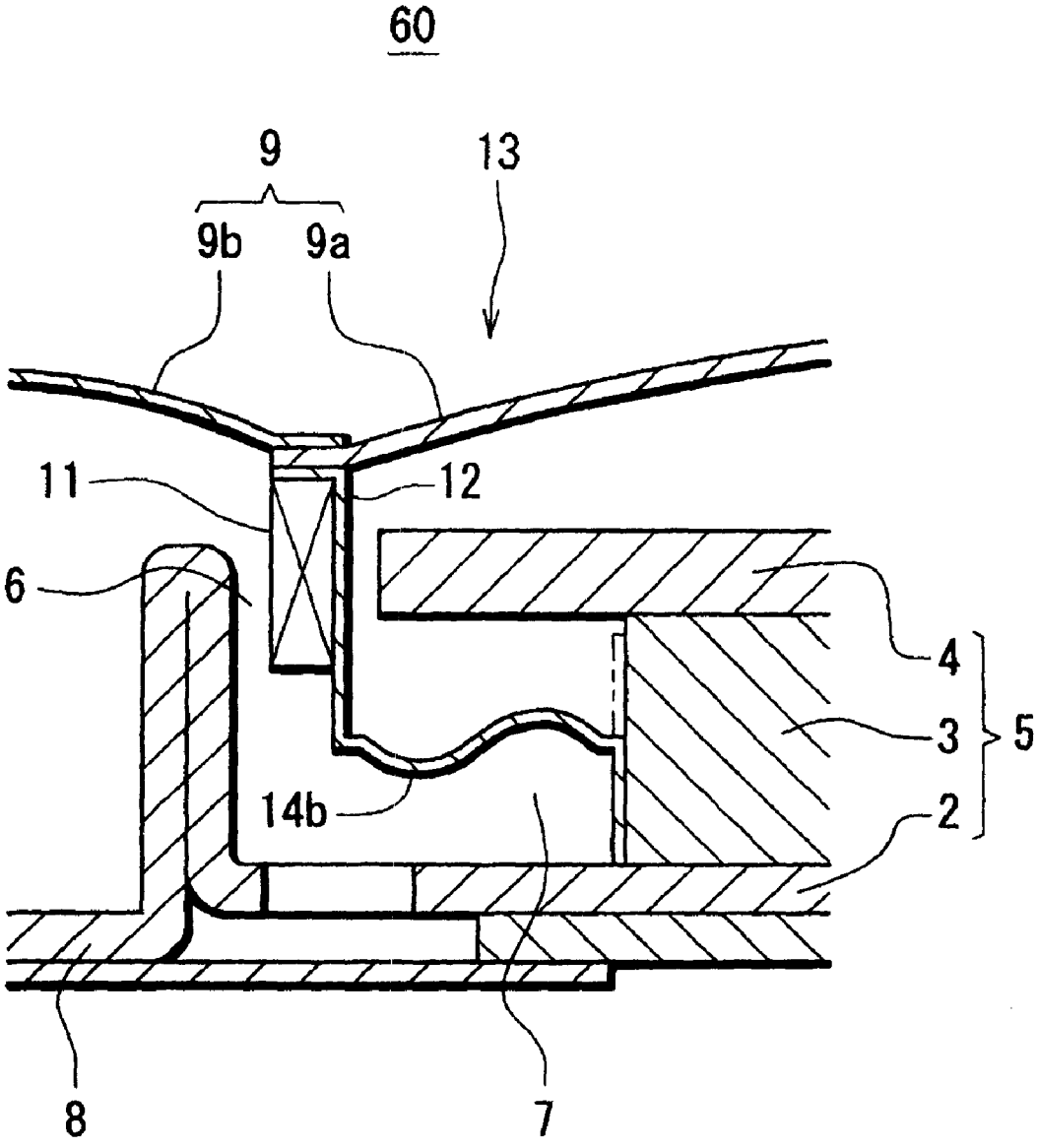
FIG. 7 is an enlarged sectional view of main portions of a still further speaker of the embodiment of the invention (Example 5).

FIG. 7 is an enlarged sectional view of main portions of a speaker of Example 5 of the invention. The speaker 60 is different from the speaker 1 of Example 1, only in a configuration where, in place of the damper 14 of the speaker 1 of Example 1, a damper 14*b* which is formed integrally with the voice coil bobbin 12, and in which an end portion on the side of the magnet is directly bonded and fixed to the outer peripheral face of the magnet 3 is disposed, and identical with the speaker 1 of Example 1 in the configuration other than the above. Therefore, the identical components are denoted by the same reference numerals, and their detailed description is omitted. As in the speaker 60 of the example, the damper 14*b* may be configured so that the end portion on the side of the magnet is directly bonded and fixed to the outer peripheral face of the magnet 3, without using the damper ring 15. As in the speaker 60 of the example, when the end portion of the damper 14*b* on the side of the magnet is bent perpendicularly to the wavy portion and bonded and fixed to the outer peripheral face of the magnet 3, the end portion of the damper 14*b* on the side of the magnet is bent downward (solid line) or upward (dash-dot-dash line) in accordance with the level position of the damper 14*b*. In the dampers 14, 14*a*, 14*b* of the speakers 1, 30, 40, 50 of Examples 1 to 4, the end portion on the side of the magnet may be directly bonded and fixed to the outer peripheral face of the magnet 3, without using the damper ring 15.

Although, in Examples 1 to 5, the invention has been described with reference to a round speaker having a circular magnetic circuit of the internal magnet type, the invention is not restricted to them, and may be variously modified without departing from the spirit of the invention. For example, the invention may be applied also to a rectangular or oval speaker having a circular or rectangular magnetic circuit of the internal magnet type, a speaker having a circular or rectangular magnetic circuit of the external magnet type in which a magnet is disposed outside a voice coil, a speaker having integral or separate yoke and frame, a speaker having a separate yoke and a resin-made frame, etc.

DESCRIPTION OF REFERENCE NUMERALS

1, 30, 40, 50, 60 speaker
2 yoke
3 magnet
4 pole piece
5 magnetic circuit
6 magnetic gap
8 frame
9, 90 diaphragm
9*b*, 90*b* edge portion
11 voice coil
12, 12*a* voice coil bobbin
14, 14*a*, 14*b* damper
15 damper ring (damper fixing member)

What is claimed is:

1. A speaker comprising:

a magnetic circuit of an internal magnet type, said magnetic circuit comprising a yoke, a magnet, and a pole piece;

a vibration system having a voice coil and diaphragm that are joined to each other through a voice coil bobbin; and a frame that holds said magnetic circuit and said vibration system, and said voice coil being placed in a magnetic gap, wherein a damper having an inner end portion and an outer end portion and being disposed between said voice coil bobbin and said magnet, said inner end portion being coupled to the magnet and said outer end portion being coupled to the voice coil bobbin so as to loin the voice coil bobbin to the magnet, and wherein said damper supports said vibration system in a manner that said vibration system is vibratable and allowing vertical vibration of the vibration system with respect to said magnet; and, said damper joins an end portion of said voice coil bobbin that is opposite to said diaphragm, to said magnet.

2. The speaker according to claim 1, wherein said damper is annularly formed, and joins a whole periphery of said voice coil bobbin to said magnet.

3. The speaker according to claim 1, wherein said diaphragm, said voice coil bobbin, and said damper are formed separately from one another.

4. The speaker according to claim 1, wherein said damper is formed integrally with said voice coil bobbin.

5. The speaker according to claim 1, wherein said damper is formed separately from said voice coil bobbin, which is formed integrally with a dome portion of said diaphragm.

6. The speaker according to claim 1, wherein a damper fixing member that is formed into an annular shape that is fittable to said magnet, and to which an end portion of said damper on a side of said magnet is fixed is disposed.

7. The speaker according to claim 1, wherein a damper fixing member that is formed into an annular shape that is fittable to said magnet, and to which an end portion of said damper on a side of said magnet is fixed is disposed, and said damper fixing member is made of a metal that is a nonmagnetic material, or a resin.

8. A speaker comprising:

a magnetic circuit of an internal magnet type, said magnetic circuit comprising a yoke with a bottom plate, a magnet, and a pole piece;

a vibration system having a voice coil and diaphragm that are joined to each other through a voice coil bobbin; and a frame that holds said magnetic circuit and said vibration system, and said voice coil being placed in a magnetic gap, wherein a damper having an inner end portion and an outer end portion and being disposed between said voice coil bobbin and said magnet, said inner end portion being coupled to the magnet and said outer end portion being coupled to the voice coil bobbin so as to join the voice coil bobbin to the magnet, and wherein said damper supports said vibration system in a manner that said vibration system is vibratable and allowing vertical vibration of the vibration system with respect to said magnet;

said damper joins an end portion of said voice coil bobbin that is opposite to said diaphragm, to said magnet, and plural openings, which are opposed to said damper, are disposed in the bottom plate of said yoke.

9. The speaker according to claim 8, wherein said plural openings are used as rear sound holes for said speaker.

10. The speaker according to claim 8, wherein said plural openings are used as rear sound holes for said speaker, some openings among said plural openings are used as holes into which, during a process of assembling said speaker, an assembling jig is to be inserted from the outside of the speaker into the interior.

* * * * *